US011078449B2

(12) United States Patent
Jackson et al.

(10) Patent No.: US 11,078,449 B2
(45) **Date of Patent: *Aug. 3, 2021**

(54) SYSTEMS AND METHODS FOR SPOTTING TREATMENT, INSPECTION, AND TRACKING OF ARTICLES

(71) Applicant: CaaStle, Inc., New York, NY (US)

(72) Inventors: Michael Jerome Jackson, Columbus, OH (US); Andrew Demaray, Chicago, IL (US); Phillip Hoffman, Woodmere, NY (US); Ericka Ponte, Delaware, OH (US)

(73) Assignee: CaaStle, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/683,614

(22) Filed: Nov. 14, 2019

(65) Prior Publication Data

US 2020/0332233 A1 Oct. 22, 2020

Related U.S. Application Data

(63) Continuation of application No. 16/388,062, filed on Apr. 18, 2019, now Pat. No. 10,513,674.

(51) Int. Cl.
*C11D 11/00* (2006.01)
*D06F 43/00* (2006.01)

(52) U.S. Cl.
CPC ..... *C11D 11/0064* (2013.01); *C11D 11/0017* (2013.01); *D06F 43/002* (2013.01); *D06M 2200/01* (2013.01)

(58) Field of Classification Search
CPC ..... C11D 11/0017; C11D 11/0064; D06F 43/002; D06M 2200/01
See application file for complete search history.

(56) References Cited

U.S. PATENT DOCUMENTS 3,619,830 A * 11/1971 Harris ..... D06F 43/002 8/149.1
5,253,378 A * 10/1993 Jung, Jr. ..... D06F 43/002 68/20
6,013,614 A * 1/2000 Mahdessian ..... C11D 3/042 206/484
6,117,833 A * 9/2000 Racherla ..... A61K 8/33 510/302
9,767,332 B1 * 9/2017 Volmut ..... A41F 1/002
2001/0049846 A1 * 12/2001 Guzzi ..... D06F 33/00 8/158
2004/0045578 A1 * 3/2004 Jackson ..... B08B 7/0035 134/1.2
2009/0078762 A1 * 3/2009 Forster ..... G06K 19/07749 235/385
2011/0173536 A1 * 7/2011 Payne ..... D06F 43/002 715/716
2013/0117946 A1 * 5/2013 Dawudian ..... D06L 1/04 8/142
2016/0275775 A1 * 9/2016 Glasgow ..... G01N 33/0001
2016/0342936 A1 * 11/2016 Milum ..... G06Q 10/087

FOREIGN PATENT DOCUMENTS

WO WO 91/04931 A1 4/1991

OTHER PUBLICATIONS

Mel Frank, How to Steam Clean to Remove odor and stains , Sep. 26, 2017 https://homesteady.com/how-5928041-steam-clean-remove-odor-stains.html.*
Carpet cleanning , 2015 http://www.kscarpet.com/mobile/Carpet.htnnl.*
Carpet cleaning, 2015 http://www.kscarpet.com/mobile/Carpet._html.

* cited by examiner

*Primary Examiner* — Amina S Khan
(74) *Attorney, Agent, or Firm* — Bookoff McAndrews, PLLC

(57) ABSTRACT

A method of treatment of one or more articles may comprise locating a stain on an article based on a tag on the article; placing the stain on a nose of a spotting board; positioning a steam gun at least two or more inches away from the stain; simultaneously activating a steam supply and a vacuum supply of the spotting board; moving the steam gun in a defined motion relative to the stain for at least 30 seconds; simultaneously activating the vacuum supply and an air supply of the spotting board; moving the steam gun in the defined motion relative to the stain until the article is at least partially dry; and inspecting the stain.

14 Claims, 6 Drawing Sheets

SYSTEMS AND METHODS FOR SPOTTING TREATMENT, INSPECTION, AND TRACKING OF ARTICLES

CROSS-REFERENCE TO RELATED APPLICATION

This application is a continuation of and claims the benefit of priority to pending U.S. application Ser. No. 16/388,062, filed Apr. 18, 2019, now U.S. Pat. No. 10,513,674, which is incorporated herein by reference in its entirety.

TECHNICAL FIELD

The present disclosure relates generally to the field of processing an article for an end user and, more particularly, to systems and methods for spotting treatment, inspection, and tracking of articles, such as articles of clothing.

BACKGROUND

The clothing and fashion industry has traditionally depended on a business model in which customers purchase goods from physical retail locations. These goods are often discarded by the customer while the item is in good condition or even excellent condition. Numerous retail locations are necessary to attract customers and provide sufficient space for the display of items and to stock items of different styles, sizes, etc. These physical retail locations are operated by teams of employees and are both labor-intensive and expensive to maintain. Additionally, each physical location can only attract consumers within a narrow geographic area. It is also expensive and difficult to adapt multiple retail locations to rapidly-changing trends.

Although many industries have successfully migrated to Internet-connected platforms, the clothing industry largely remains dependent on physical retail stores and traditional business models. Even when a sale of clothing is performed over the Internet, the item may still be used infrequently by a single consumer before being discarded. Thus, the fashion and clothing industry also produces a significant amount of waste.

Various challenges face retailers seeking to transition to alternate strategies that provide items for short-term or temporary use. One such challenge lies in managing inbound articles for inspection, maintenance, cleaning, research, or stocking, and accumulating useful data based on the result of each activity. Current clothing rental services clean or treat articles in an only cursory manner, if cleaning or treatment is performed at all. Even when a more rigorous cleaning treatment is performed, data associated with the treatment are not recorded.

The present disclosure is directed to overcoming one or more of the above-referenced drawbacks to prior techniques for distributing and spot cleaning articles.

SUMMARY OF THE DISCLOSURE

In an aspect, a method of treatment of one or more articles may comprise locating a stain on an article based on a tag on the article; placing the stain on a nose of a spotting board; positioning a steam gun at least two or more inches away from the stain; simultaneously activating a steam supply and a vacuum supply of the spotting board; moving the steam gun in a defined motion relative to the stain for at least 30 seconds; simultaneously activating the vacuum supply and an air supply of the spotting board; moving the steam gun in the defined motion relative to the stain until the article is at least partially dry; and inspecting the stain, and if the stain is removed, hanging the article on a rack to dry, wherein the article is at least 10 inches from another article on the rack; or if the stain is not removed, treating the article with a spotting agent treatment.

In some embodiments, the spotting agent treatment may comprise placing the stain on a glass of the spotting board. In some embodiments, the spotting agent treatment may further comprise identifying a type of the stain and referencing one or more spotting agents for the type of the stain. In some embodiments, the spotting agent treatment may further comprise determining whether the stain is a wet-side stain or a dry-side stain. In some embodiments, the spotting agent treatment may further comprise applying the one or more spotting agents on the stain. In some embodiments, the spotting agent treatment may further comprise treating the stain in a side-to-side motion for at least 10 seconds while a brushing action is not used on the article. In some embodiments, the spotting agent treatment may further comprise placing the stain on the nose of the spotting board. In some embodiments, the spotting agent treatment may further comprise positioning the steam gun at least 3 inches from the stain. In some embodiments, the spotting agent treatment may further comprise simultaneously activating the steam supply and the vacuum supply of the spotting board. In some embodiments, the spotting agent treatment may further comprise moving the steam gun in the defined motion relative to the stain for at least 30 seconds.

In some embodiments, the spotting agent treatment may further comprise simultaneously activating the vacuum supply and the air supply of the spotting board. In some embodiments, the spotting agent treatment may further comprise moving the steam gun in the defined motion relative to the stain until the article is at least partially dry. In some embodiments, the spotting agent treatment may further comprise inspecting the stain, and if the stain is removed, hanging the article on the rack to dry, wiping the glass with a towel, and flushing spotting bone or brushes with the stream gun; or if the stain is not removed, recording information of the article and the stain in the tag and hanging the article in a retiring rack to be audited. In some embodiments, the spotting agent treatment may further comprise recording all articles on a spotting productivity tracker and turning the spotting productivity tracker in. In some embodiments, the tag may comprise a barcode. In some embodiments, the tag may be in communication with a server system. In some embodiments, the defined motion may be a circular motion.

Additional aspects and advantages of the present disclosure will become readily apparent to those skilled in this art from the following detailed description, wherein only exemplary embodiments of the present disclosure are shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

It is believed that certain embodiments will be better understood from the following description taken in conjunction with the accompanying drawings, in which like references indicate similar elements and in which.

DETAILED DESCRIPTION OF EMBODIMENTS

As described above, retailers face various challenges in distributing and processing articles (e.g., articles of closing) for short-term or temporary use. One challenge lies in managing inbound articles for inspection, maintenance, cleaning, research, or stocking, and accumulating useful data based on the result of each activity. Current rental services clean or treat articles in a cursory manner, if cleaning or treatment is performed at all. Even when a more detailed treatment is performed, data associated with the treatment are not recorded.

Accordingly, the present disclosure is directed to systems and methods for treating an article, such as an article of clothing, provided for multiple end users, and for tracking and evaluating information during and after the treatment. Furthermore, as vast amounts of information may be collected in numerous different categories, the present disclosure is also directed to systems and method configured to facilitate data management. Thus, the present disclosure is directed to systems and methods for processing an article for an end user and, more particularly, to systems and methods for performing and tracking spotting treatment for articles provided to multiple end users.

While principles of the present disclosure are described herein with reference to illustrative embodiments for particular applications, it should be understood that the disclosure is not limited thereto. Those having ordinary skill in the art and access to the teachings provided herein, will recognize that the features illustrated or described with respect to one embodiment, may be combined with the features of another embodiment. Therefore, additional modifications, applications, embodiments, and substitution of equivalents, all fall within the scope of the embodiments described herein. Accordingly, the invention is not to be considered as limited by the foregoing description. Various non-limiting embodiments of the present disclosure will now be described to provide an overall understanding of the principles of the structure, function, and use of systems and methods for spotting treatment of articles.

As used herein, the terms "comprises," "comprising," or any other variation thereof, are intended to cover a non-exclusive inclusion, such that a process, method, article, or apparatus that comprises a list of elements does not include only those elements, but may include other elements not expressly listed or inherent to such process, method, article, or apparatus. Unless stated otherwise, the term "exemplary" is used in the sense of "example," rather than "ideal." Words using the singular or plural number also include the plural or singular number respectively. Additionally, the words 'herein,' 'hereunder,' 'above,' 'below,' and words of similar import refer to this application as a whole and not to any particular portions of this application.

Figure 1:
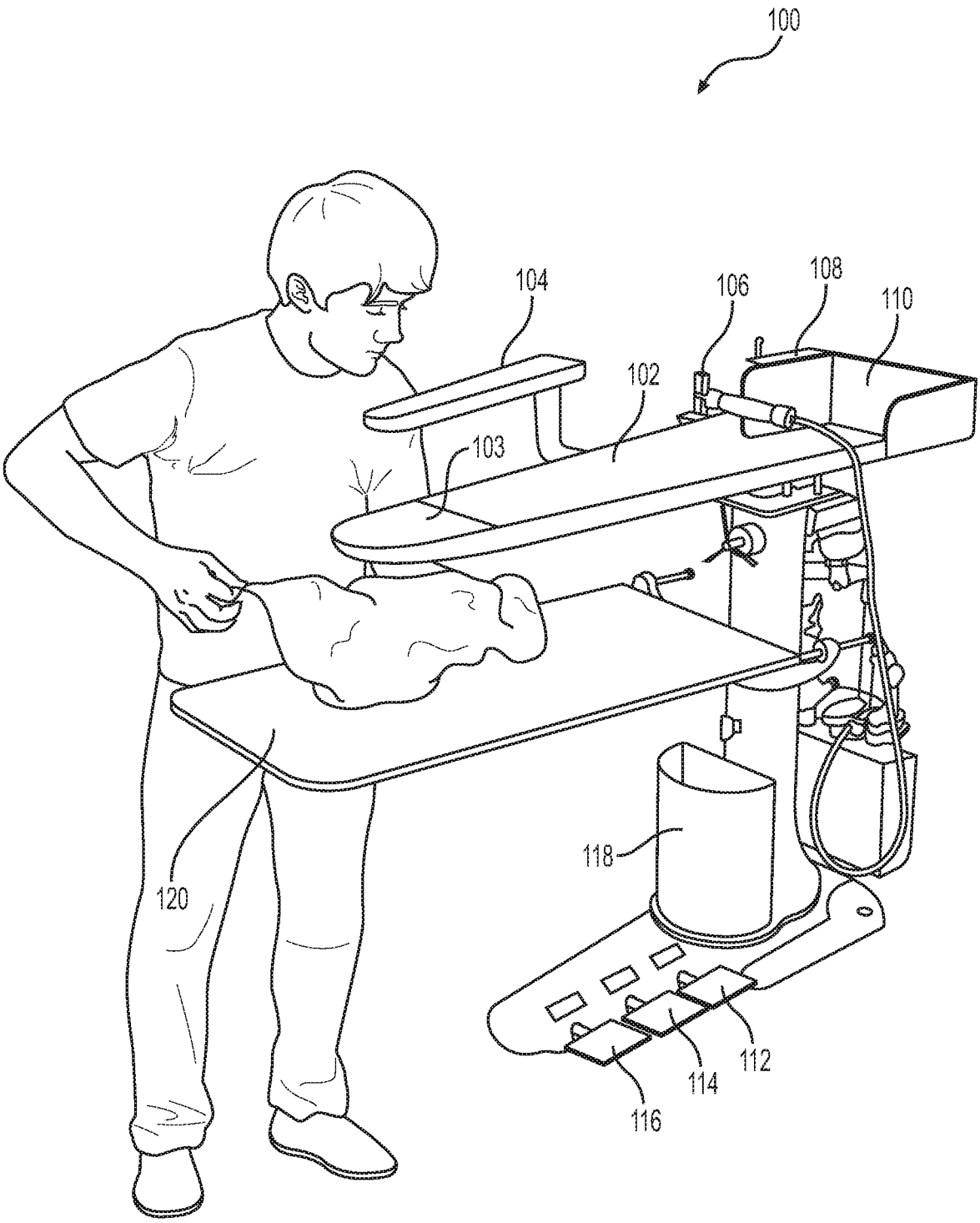
FIG. 1 is a view of an exemplary spotting board of a spotting and inspection station.

FIG. 1 illustrates an exemplary spotting board 100 of a spotting, inspection, and tracking station, e.g., of an incoming and/or outbound article warehouse. As shown in FIG. 1, the exemplary spotting board 100 comprises a glass 102, a nose 103, a sleeve board 104, a steam/air gun 106, a brush holder 108, an agent holder 110, an air pedal 112, a vacuum pedal 114, a steam pedal 116, a drain receptacle 118, and a fabric tray cover 120. In FIG. 1, a user (e.g., a person trained to perform the steps, but optionally a robot or other automated or mechanical device) is performing a treatment process to an article. It should be appreciated that all of the techniques disclosed herein are equally applicable to performance of the any combination of the disclosed steps by any combination of a human and/or a machine, such as a robot.

In addition to the spotting board, other tools or resources may be used for spotting treatment. Examples such tools and resources may comprise electronic devices (e.g., computers and scanners), workstations (e.g., an area where the spotting board is located), racks for hanging articles (e.g., white mesh rolling drying racks), vacuum, gloves, spotting brushes, spotting bone, wet-side spotting agents, dry-side spotting agents, squeeze bottles, spray bottles, towels, stain identification information, and colored bags (e.g., black bags for regular articles and pink bags for articles that need special care). Any of these tools and/or resources may be adapted for use by a person trained in spotting and inspection, and/or by an automated machine (e.g., a robot) trained in spotting and inspection.

Before any treatment is performed on the articles, one or more steps may be conducted. The one or more steps may comprise ensuring that the vacuum is turned on; stocking all tools and resources at the workstation; stocking all spotting agents on the spotting boards; ensuring that the steam, air and vacuum are operational at the workstation; and ensuring there are clean white towels close to the workstation. In one embodiment, the one or more steps may be done by a user. The user may be a person trained to perform the one or more steps. In another embodiment, the one or more steps may be done by a machine, such as a robot.

Figure 2:
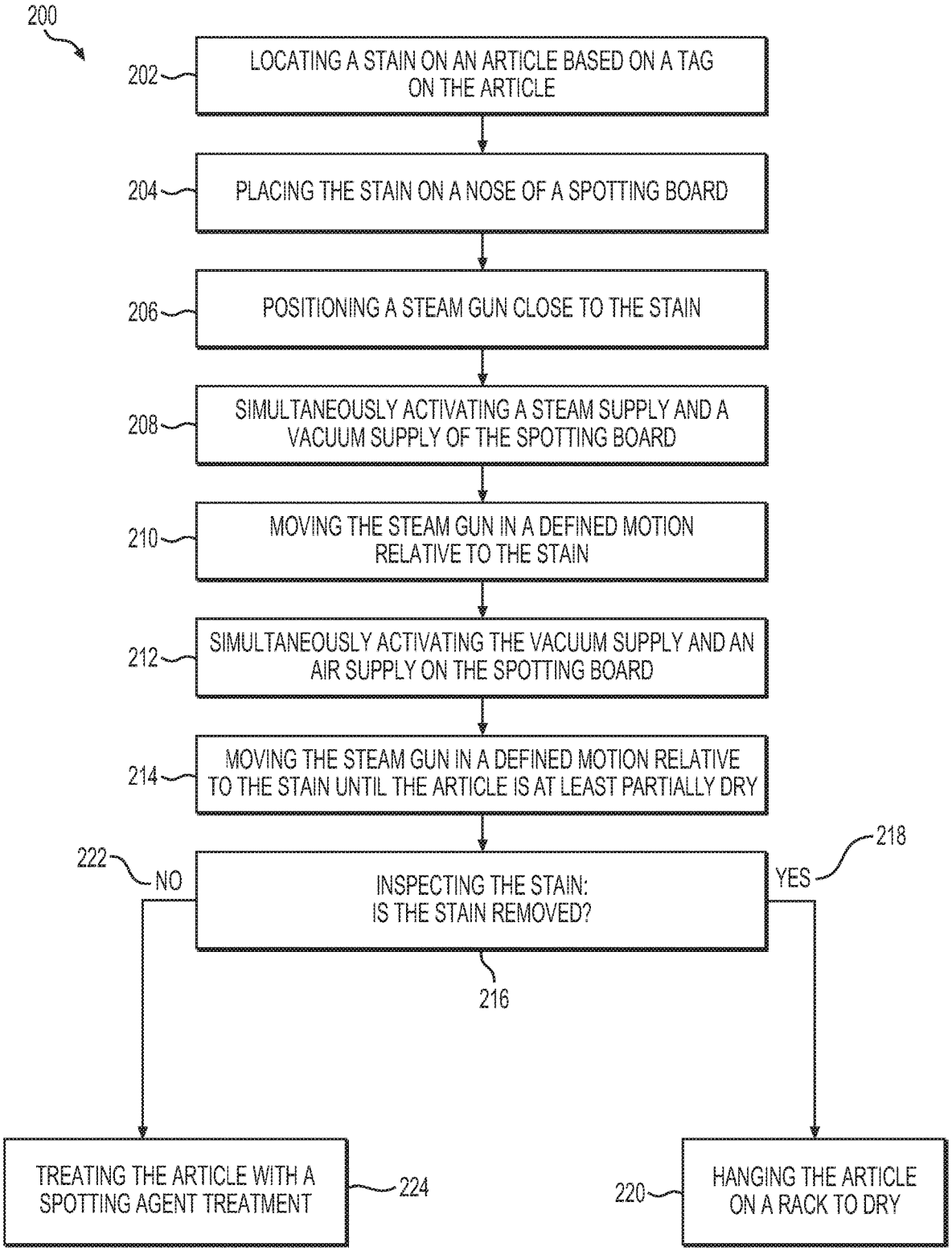
FIG. 2 is an exemplary flow chart of one method of spotting, treatment, and inspection of an article.

FIG. 2 illustrates an exemplary flow chart of one method of treatment of articles with a spotting board of a spotting and inspection station of the article warehouse. As shown in FIG. 2, the method of treatment of an article 200 may comprise a first step of locating a stain on an article. In one embodiment, the stain may be located on the article based on a tag on the article 202, where the tag indicates the location and type of stain within the article. In one embodiment, the locating step 202 may be performed by a user based on visual inspection. The user may be a person trained to perform the locating step. In another embodiment, the locating step 202 may be done by a machine, such as a robot. The stain may be a colored patch or dirty mark. The stain may be in any color, shape or size. For instance, the stain may be in any two-dimensional shape, such as a circle or rectangle. The article may be any goods, such as clothes, accessories, shoes, bags, bedding, linens, or carpets. The clothes may comprise a blazer, coat, blouse, jacket, dress, jeans, jumper, pants, sweaters, swimsuit, T-shirt, shirt, suit, underwear, or gown. The tag may be attached to the article through an attaching mechanism. The attaching mechanism may comprise magnetic attachment, string attachment, or any other fastening mechanism. The details of an exemplary tag are described elsewhere herein.

The method of treatment of the article 200 may further comprise step 204 of placing the stained portion of the article on a nose of a spotting board. In one embodiment, the placing step 204 may be done by a user. The user may be any person that is trained to perform the placing step. In another embodiment, the placing step 204 may be done by a machine, such as a robot. An exemplary spotting board 100 is shown in FIG. 1. The nose of the spotting board may be in any shape, size, or design. The nose of the spotting board may be coated with a coating layer to avoid corrosion. For instance, the coating layer may be acid or alkali proof.

The method of treatment of the article 200 may further comprise step 206 of positioning a steam gun at least two (2) or at least three (3) inches from the stain. While the steam gun is disclosed as being positioned at least two (2) or at least three (3) inches from the stain, it should be appreciated that in other embodiments, the steam gun is positioned optionally abutting the article, within one inch of the article, or possibly at least 4-6 inches from the article, as desired. In one embodiment, the positioning step 206 may be done by a user. The user may be any person that is trained to perform the positioning step. In another embodiment, the positioning step 206 may be done by a machine, such as a robot. The steam gun may be integral to the spotting board. In another embodiment, a separate steam gun machine may be provided and connected to the spotting board. The steam gun may be positioned at least about 1, 2, 3, 4, 5, 6, 7, 8, 9, 10 or more inches from the stain. In some other embodiments, the steam gun may be positioned at most about 10, 9, 8, 7, 6, 5, 4, 3, 2, 1 or fewer inches from the stain. In yet another embodiment, the steam gun may be positioned between about 1 and 10 inches, 2 and 9 inches, 2 and 8 inches, 2 and 7 inches, 2 and 6 inches, 2 and 5 inches, or 3 and 4 inches from the stain.

The method of treatment of the article 200 may further comprise step 208 of simultaneously activating a steam supply and a vacuum supply of the spotting board. In other embodiments, instead of being activated simultaneously, the steam supply and the vacuum supply may be activated at different times. For instance, the steam supply may be activated first and the vacuum supply may be activated later, or the vacuum supply may be activated first and the steam supply may be activated later. In one embodiment, the activating step 208 may be done by a user. The user may be any person that is trained to perform the activating step. In another embodiment, the activating step 208 may be done by a machine, such as a robot. The steam supply may be activated by a steam pedal of the spotting board. The vacuum supply may be activated by a vacuum pedal of the spotting board.

The method of treatment of the article 200 may further comprise step 210 of moving the steam gun in a defined motion relative to the stain for at least 30 seconds. In one embodiment, the moving step 210 may be done by a user. The user may be any person that is trained to perform the moving step. In another embodiment, the moving step 210 may be done by a machine, such as a robot. The defined motion may be a movement that follows any type of path. The path may be a two-dimensional or three-dimensional path. Examples of the defined movement paths may comprise circular paths, rectangular paths, triangular paths, or linear paths. If the defined motion is a circular motion, the circular motion may be uniform, with constant angular rate of rotation and constant speed, or non-uniform with a changing rate of rotation. The steam gun may be moved in the defined motion relative to the stain for at least about 1, 5, 10, 20, 30, 40, 50, 60, 70, 80, 90 or more seconds. In other embodiments, the steam gun may be moved in the defined motion relative to the stain for at most about 90, 80, 70, 60, 50, 40, 30, 20, 10, 5, 1 or fewer seconds.

The method of treatment of the article 200 may further comprise step 212 of simultaneously activating the vacuum supply and an air supply of the spotting board. In some other embodiments, instead of being activated simultaneously, the air supply and the vacuum supply may be activated at different times. For instance, the air supply may be activated first and the vacuum supply may be activated later, or the vacuum supply may be activated first and the air supply may be activated later. In one embodiment, the activating step 212 may be done by a user. The user may be any person that is trained to perform the activating step. In another embodiment, the activating step 212 may be done by a machine, such as a robot. The air supply may be activated by an air pedal of the spotting board. The vacuum supply may be activated by a vacuum pedal of the spotting board.

The method of treatment of the article 200 may further comprise step 214 of moving the steam gun in the defined motion relative to the stain until the article is at least partially dry. In one embodiment, the moving step 214 may be done by a user. The user may be any person that is trained to perform the moving step. In another embodiment, the moving step 214 may be done by a machine, such as a robot. The defined motion is described elsewhere herein. For thick or heavy articles, the steam gun may be moved in the defined motion relative to the stain until the articles are damp to touch. In some other cases, the steam gun may be moved in the defined motion relative to the stain until the article is fully dry.

The method of treatment of the article 200 may further comprise step 216 of inspecting the stain and if the stain is removed (step 218), then hanging the article on a rack to dry, wherein the article is at least 10 inches from another article on the rack (step 220); or if the stain is not removed (step 222), then treating the article with a spotting agent treatment (step 224). In one embodiment, the steps of inspecting 216, hanging 220, and/or treating 224 may be done by a user. The user may be any person that is trained to perform the inspecting, hanging, and/or treating steps. In another embodiment, the steps of inspecting 216, hanging 220, and/or treating 224 may be done by a machine, such as a robot. One or more apparatuses may be used to inspect the article. The one or more apparatuses may comprise one or more sensors, cameras, magnifiers, or lights. The one or more sensors may comprise light sensors, chemical sensors, humidity sensors, color sensors, or odor sensors. If the stain is removed, the article may be hung on a rack to dry. In this situation, the article may be at least about 1, 2, 4, 6, 10, or 12 or more inches from another article on the rack. In another embodiment, the article may be at most about 12, 10, 6, 4, 2, or 1 or fewer inches from another article on the rack. In some embodiments, the article, once fully dry, may be re-inspected to ensure that the stain is completely removed before further treatments and processes.

Figure 3:
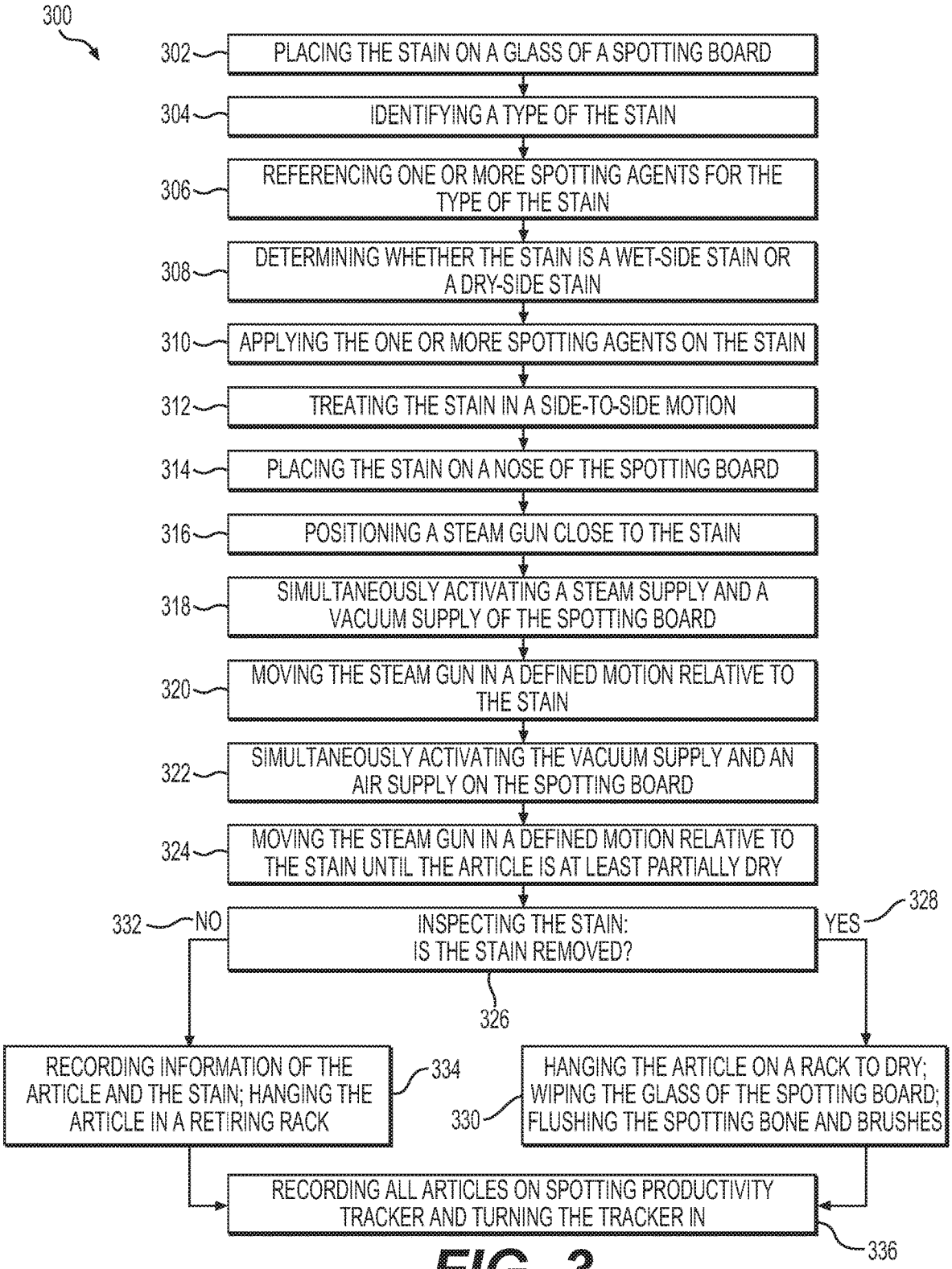
FIG. 3 is an exemplary flow chart of another method of spotting agent treatment, re-inspection, and tracking of an article.

A spotting agent treatment may follow the above-mentioned treatment or may be an independent treatment that does not follow the above-mentioned treatment. FIG. 3 shows an exemplary method 300 for performing spotting agent treatment. The spotting agent treatment method 300 may comprise a first step 302 of placing the stain on a glass of a spotting board. In one embodiment, the placing step 302 may be done by a user. The user may be any person that is trained to perform the placing step. In another embodiment, the placing step 302 may be done by a machine, such as a robot.

The spotting agent treatment method 300 may further comprise step 304 of identifying a type of the stain and step 306 of referencing one or more spotting agents for the type of the stain. In one embodiment, the identifying step 304 or referencing step 306 may be done by a user. The user may be any person that is trained to perform the identifying step or referencing step. In another embodiment, the identifying step 304 or referencing step 306 may be done by a machine, such as a robot. Table 1 shows an example of a list of stains and their types. Table 1 also shows, for each type of stain (e.g., group A, B, C, D, E, or F), the relevant spotting agents and stain removal procedures. For example, in Table 1, a gum stain is identified as a group A stain. Therefore, for the gum stain, the relevant spotting agents may comprise P.O.G and Citrasol; and the relevant stain removal procedures may comprise: 1) using Spray-Tex on the stain; 2) using P.O.G. on the stain; 3) using air and vacuum; 4) using steam; 5) using Citrasol; 6) steaming and drying the article; and 7) flushing thoroughly. In another example, the egg stain in Table 1 is identified as a group D stain. Thus, for the egg stain, the relevant spotting agents may comprise Neutra Lube and Para-tein; and the relevant stain removal procedures may comprise: 1) using steam or water; 2) using Neutra Lube; 3) using Para-tein; and 4) flushing thoroughly.

TABLE 1

| LIST OF STAINS & GROUP | STAIN REMOVAL PROCEDURES |
|---|---|
| Alcoholic beverages. C | Group A: Oils & Fats |
| Ball point pen. F | 1. Spray-Tex |
| Beer. C | 2. P.O.G. |
| Blood. D | 3. Air & Vacuum |
| Catsup. C | 4. Steam |
| Coffee. C | 5. Citrasol |
| Crayons. F | 6. Steam & Dry |
| Egg. D | Flush thoroughly! |
| Fats. A | GROUP B: Plastic and, in some cases, pigment |
| Flower stains - Pollen. C | or dye. |
| Food coloring. E | 1. Steam/Water |
| Foundation makeup. F | 2. Neutra Lube |
| Fruit juice. C | 3. Para-tann |
| Glue. B | 4. Rust remover |

TABLE 1-continued

| LIST OF STAINS & GROUP | STAIN REMOVAL PROCEDURES |
|---|---|
| Grass. C | Flush thoroughly! |
| Grease. A | GROUP D: Protein/animal albuminous material |
| Gum. A | 1. Steam/Water |
| Gutter splash. F | 2. Neutra Lube |
| Household cement. B | 3. Para-tein |
| Ice cream. D | Flush thoroughly! |
| India ink. F | GROUP E: Dye stains |
| Kool-Aid. E | 1. Steam/Water |
| Lacquer. B | 2. Neutra Lube |
| Lipstick. F | 3. Para-tann |
| Magic Marker. F | 4. Rust remover |
| Mascara. F | 5. Para-tein |
| Mayonnaise. A | Flush thoroughly! |
| Milk. D | GROUP F: Combination stains, consist of a |
| Mustard. C | vehicle (resin, fat, oil, wax, or grease), a |
| Nail polishes. B | pigment and/or dye |
| Paint. F | 1. P.O.G. |
| Perspiration (Sweat). D | 2. Air & Vacuum |
| Perfume. G | 3. Repeat steps 1-2, if necessary |
| Shoe polishes. F | 4. Steam/Water |
| Soft drinks. C | 5. Neutra Lube |
| Soot. F | 6. Para-tein |
| Soy sauce. C | 7. Para-tann |
| Suntan lotion. H | 8. Rust remover |
| Tar. F | Flush thoroughly! |
| Tea. C | GROUP G: Perfume |
| Tomato Sauce. C | 1. Shot Spot |
| Urine. D | 2. Activate |
| Varnish. F | Flush thoroughly! |
| Vegetable oil. A | GROUP H: Unknown Stains |
| Vomit. D | 1. Steam/Water |
| Wax. A | 2. Neutra Lube |
| White-out. B | 3. Para-tann |
| Wine. C | 4. Rust remover |
| | 5. Para-tein |
| | 6. Activate |
| | Flush thoroughly! |

Table 2 shows another example of a list of stains and their types, and, for each type of stain (e.g., group A, B, C, D, E, or F), the relevant spotting agents and stain removal procedures. Table 2 also shows that for some articles with certain types of stains (e.g., Group A), re-cleaning may be performed before a spot removal procedure.

TABLE 2

| LIST OF STAINS & GROUP | STAIN REMOVAL PROCEDURES |
|---|---|
| Alcoholic beverages. C | Group A: Oils & Fats |
| Ball point pen. F | 1. Apply Spray-tex & tamp/flush using air & |
| Beer. C | vacuum |
| Blood. D | 2. Apply P.O.G. & tamp/flush using air & vacuum |
| Catsup. C | 3. Apply Steam/Water |
| Coffee. C | 4. Apply Shot Spot/tamp/flush using steam & dry |
| Crayons. F | TIPS: Garments must be DRY (with no |
| Egg. D | moisture remaining in the fabric) before |
| Fats. A | dry cleaning. Re-cleaning after Rust Remover is |
| Flower stains - Pollen. C | used. Do not tamp Rust Remover. |
| Food coloring. E | GROUP B: Plastic and, in some cases, pigment |
| Foundation makeup. F | or dye. |
| Fruit juice. C | 1. Apply P.O.G. (contains amyl)/tamp/flush using |
| Glue. B | air & vacuum) |
| Grass. C | 2. If needed, reapply & use spotting bone to gently |
| Grease. A | massage |
| Gum. A | 3. Flush using air & vacuum |
| Gutter splash. F | 4. Dry Clean - DO NOT WET CLEAN with POG in |
| Household cement. B | fabric |
| Ice cream. D | GROUP C: Tannin Stains |
| India ink. F | 1. Apply Steam/Water |
| Kool-Aid. E | 2. Apply Neutra Lube & tamp |
| Lacquer. B | 3. Apply Para-tann & tamp/flush using steam |
| Lipstick. F | 4. Apply Rust Remover. Flush w/steam. |

TABLE 2-continued

| LIST OF STAINS & GROUP | STAIN REMOVAL PROCEDURES |
|---|---|
| Magic Marker. F | GROUP D: Protein/animal albuminous material |
| Mascara. F | 1. Apply Steam/Water |
| Mayonnaise. A | 2. Apply Neutra Lube & tamp |
| Milk. D | 3. Apply Para-tein & tamp. Flush using steam. |
| Mustard. C | GROUP E: Dye Stains |
| Nail polishes. B | 1. Apply P.O.G. |
| Paint. F | 2. Air & Vacuum |
| Perspiration (Sweat). D | 3. Apply Para-tann/tamp/flush using steam. |
| Perfume. G | 4. Apply Para-tein/tamp/flush using steam. |
| Shoe polishes. F | 1. For Blue, black, green, & violet dye |
| Soft drinks. C | stains - Use Steps 1-4. |
| Soot. F | 2. For Red, yellow, & orange dye stains - Use |
| Soy sauce. C | Steps 1 & 2, then Step 4. Para-tein, then |
| Suntan lotion. H | Step 3, & Para-tann. |
| Tar. F | GROUP F: Combination stains, consist of a |
| Tea. C | vehicle (resin, fat, oil, wax, or grease), a |
| Tomato Sauce. C | pigment and/or dye |
| Urine. D | 1. Apply Spray-tex/tamp/flush using air & vacuum |
| Varnish. F | 2. Apply P.O.G./tamp/flush using air & vacuum |
| Vegetable oil. A | 3. Repeat steps 1-2, if necessary |
| Vomit. D | 4. Apply Steam/Water & Para-tein, tamp & flush |
| Wax. A | using steam |
| White-out. B | GROUP G: Perfume |
| Wine. C | 1. Apply Steam/Water & Shot Spot |
| | 2. Tamp/flush using steam |
| | 3. Wetclean or Dryclean (dry first) |
| | GROUP H: Unknown Stains |
| | 1. Apply Spray-tex/tamp/flush using air & vacuum |
| | 2. Apply P.O.G./tamp/flush using air & vacuum |
| | 3. Apply Neutra/tamp/apply Para-tann/tamp/flush using steam |
| | 4. Apply Rust Remover/flush using steam. |
| | 5. Apply Neutra Lube & tamp |
| | 6. Apply Para-tein/tamp/flush using steam |
| | CAUTION - Always reclean when Rust Remover is used! |

The spotting agent treatment 300 may further comprise step 308 of determining whether the stain is a wet-side stain or dry-side stain. In one embodiment, the determining step 308 may be done by a user. The user may be any person that is trained to perform the determining step. In another embodiment, the determining step 308 may be done by a machine, such as a robot. The wet-side stain may be a stain directly in contact with water or steam. The wet-side stain may also be a hydrophilic stain. The dry-side stain may be a stain indirectly in contact with water or steam. The dry-side stain may also be a hydrophobic stain. The wet-side stain and the dry-side stain may be treated with different spotting agents. The wet-side stain and the dry-side stain may be treated with the same spotting agents.

The spotting agent treatment 300 may further comprise step 310 of applying one or more spotting agents on the stain. In one embodiment, the applying step 310 may be done by a user. The user may be any person that is trained to perform the applying step. In another embodiment, the applying step 310 may be done by a machine, such as a robot. One or more apparatuses may be used by the user or the machine to apply the one or more spotting agents on the stain. The one or more apparatuses may comprise a spray gun, spotting brush, or spotting bone.

The spotting agent treatment 300 may further comprise step 312 of treating the stain in a side-to-side motion for at least 10 seconds without any brushing action being used on the article. In some other embodiments, when the stain is treated in a side-to-side motion, a brushing action may be used on the article. In one embodiment, the treating step 312 may be done by a user. The user may be any person that is trained to perform the treating step. In another embodiment, the treating 312 step may be done by a machine, such as a robot. The stain may be treated in a side-to-side motion for at least about 1, 5, 10, 20, 30, 40, 50, 60, 70, 80, 90 or more seconds. In other embodiments, the stain may be treated in a side-to-side motion for at most about 90, 80, 70, 60, 50, 40, 30, 20, 10, 5, 1 or fewer seconds.

The spotting agent treatment 300 may further comprise step 314 of placing the stain on a nose of the spotting board. The spotting agent treatment 300 may further comprise step 316 of positioning the steam gun at least 3 inches from the stain. The spotting agent treatment 300 may further comprise step 318 of simultaneously activating a steam supply and a vacuum supply of the spotting board. The spotting agent treatment 300 may further comprise step 320 of moving the steam gun in a defined motion relative to the stain for at least 30 seconds. The spotting agent treatment 300 may further comprise step 322 of simultaneously activating the vacuum supply and an air supply of the spotting board. The spotting agent treatment 300 may further comprise step 324 of moving the steam gun in the defined motion relative to the stain until the article is at least partially dry. The above-mentioned placing step, positioning step, activating steps, and moving steps are described elsewhere herein.

The spotting agent treatment 300 may further comprise step 332 of inspecting the stain (step 326) and if the stain is removed (step 328), hanging the article on the rack to dry, wiping the glass with a towel, and flushing the spotting bone or brushes with the stream gun (step 330); or if the stain is not removed, recording information of the article and the stain in the tag and hanging the article in a retiring rack to be audited (step 334). In one embodiment, the steps of inspecting 326, hanging 330, wiping 330, flushing 330, and/or recording 334 may be done by a user. The user may be any person that is trained to perform these steps. In another embodiment, the steps of inspecting 326, hanging 330, wiping 330, flushing 330, and/or recording 334 may be done by a machine, such as a robot. One or more apparatuses may be used when inspecting the article. The one or more apparatuses may comprise one or more sensors, cameras, magnifiers, or lights. The one or more sensors may comprise light sensors, chemical sensors, humidity sensors, color sensors, or odor sensors. If the stain is removed, the article may be hung on a rack to dry. In this situation, the article may be at least about 1, 2, 4, 6, 10, or 12 or more inches from another article on the rack. In another embodiment, the article may be at most about 12, 10, 6, 4, 2, 1 or fewer inches from another article on the rack. The spotting bone or brushes may be used to apply spotting agents on the articles. The auditing may be performed by a person (e.g., a supervisor) or a machine (e.g., a robot or computer system). In some embodiments, the article, once fully dry, may be re-inspected to ensure that the stain is completely removed before further treatments and processes.

The spotting agent treatment 300 may further comprise step 336 of recording all articles on a spotting productivity tracker and turning the spotting productivity tracker. The all articles may comprise the articles with stain removed through the spotting agent treatment. The all articles may also comprise the articles still having the stain even after the spotting agent treatment. In one embodiment, the recording and turning in step 336 may be done by a user. The user may be any person that is trained to perform the recording and turning in step 336. In another embodiment, the recording and turning in step 338 may be done by a machine, such as a robot. The information recorded may comprise whether the stain on the article is removed, whether the stain is a dry-side stain or wet-side stain, the spotting treatment and/or procedures applied on the stain, or the type of the stain. The spotting productivity tracker may be a separate label other than the tag. The spotting productivity tracker may be integral to the tag. An auditing step may follow the step 336, and the auditing step may be performed by a human (e.g., a supervisor) or a machine (e.g., a robot or a computer).

Figure 4A:
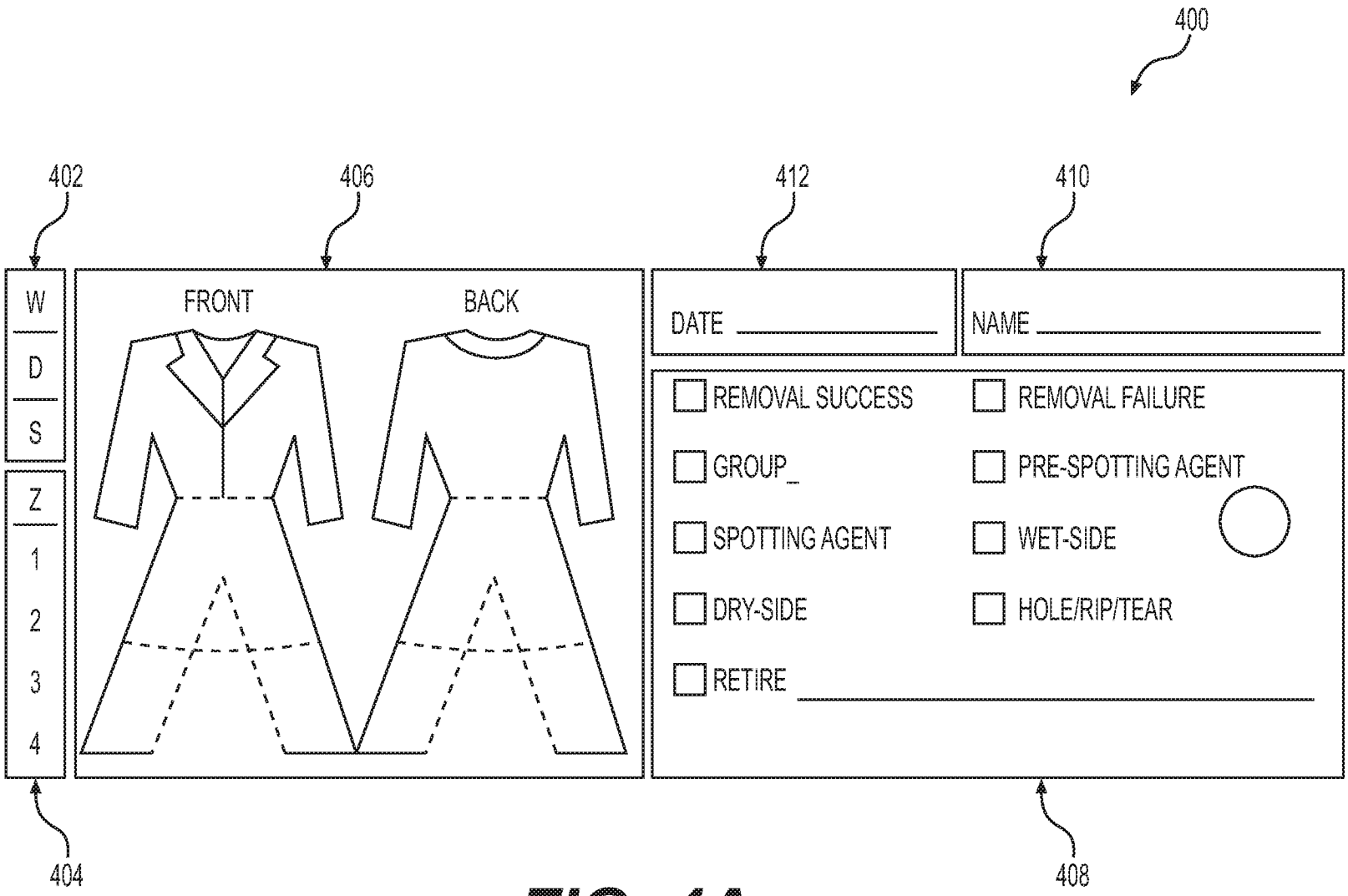
FIG. 4A is a view of an exemplary tag for tracking spotting, treatment, and inspection of articles.

FIG. 4A shows an exemplary tag 400 attached to an article. The tag 400 may comprise a care indication 402 (e.g., "W" for wet cleaning, "D" for dry cleaning, or "S" for special care), a zone 404 in which a cause for the failure of removing the stain is present (e.g., Z, or zone: 1, 2, 3, or 4), images of a front and back of an article 406, and a spotting treatment tracker 408. The spotting treatment tracker 408 may comprise recorded information of the article and/or the stain. The recorded information may comprise the type of the stain, what type of pre-spotting agent is used, what type of spotting agent is used, whether the stain is a wet-side or dry-side stain, or whether the stain is removed. Thus, when article is transferred to additional processing area, supervisors or users may identify any additional steps that the article needs for the spotting treatment. The tag 400 may also comprise a name of the supervisor or user 410 and a date of the treatment 412.

Figure 4B:
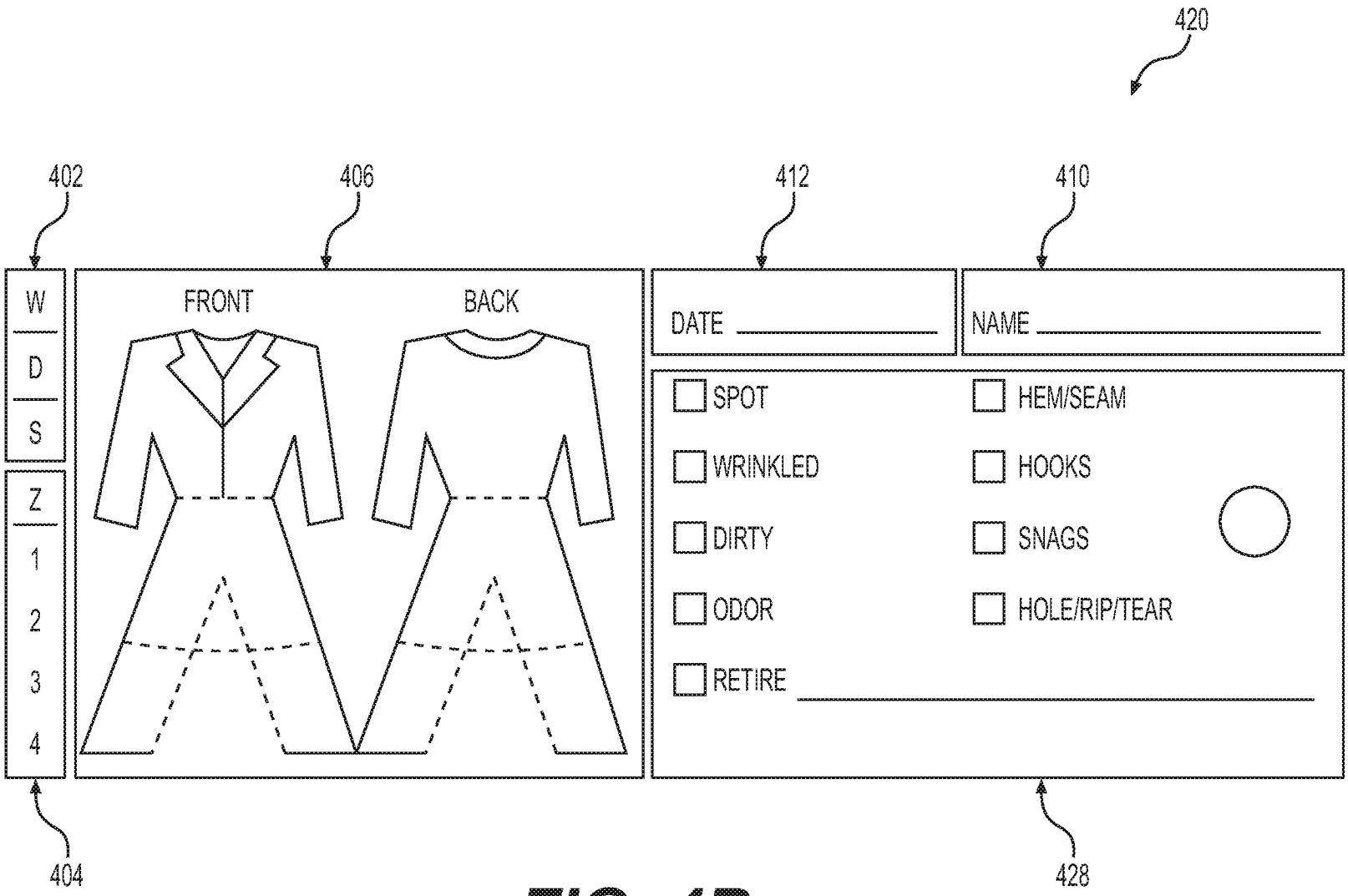
FIG. 4B is a view of another exemplary tag for tracking spotting, treatment, and inspection of articles

FIG. 4B shows another exemplary tag 420 attached to an article. The tag 420 may comprise a care indication 402 (e.g., "W" for wet cleaning, "D" for dry cleaning, or "S" for special care), a zone 404 in which a cause for the failure of removing the stain is present (e.g., Z, or zone: 1, 2, 3, or 4), images of a front and back of an article 406, and a stain identification tracker 428. The stain identification tracker 428 may comprise recorded information of the article and/or the stain. The recorded information may comprise the information regarding the type of the stain. The tag 420 may also comprise a name of the supervisor or user 410 and a date of the treatment 412.

Additional steps such as quality control steps may be included. The quality control steps may comprise: 1) placing all retired articles on the designated rack for review by a supervisor; 2) posting a copy of spotting cheat sheet at each workstation; and/or 3) posting work instructions at each workstation.

In certain embodiments, cashmere articles may be treated differently from other types of articles. For example, in certain embodiments, cashmere articles may be treated with a pre-spotting agent. The pre-spotting agent may comprise Neutra Lube or Spray-Tex. After using the neutral wet-side pre-spotting agents (e.g., Neutra Lube) and techniques on the spotting board, the cashmere articles may be dried such that moisture in the article may be removed. The moisture may have been introduced from the pre-spotting agents, spotting agents, or steam or water from the steam gun. The cashmere articles may be 100% dry before dry cleaning process to avoid shrinkage in the dry cleaning process. After using the neutral dry-side pre-spotting agents (e.g., Spray-Tex) and techniques on the spotting board, the cashmere articles may avoid an additional drying process. In one embodiment, no acids (e.g., tannins) or alkalis (e.g., proteins) may be applied to cashmere articles. The steam gun, the air gun or the spotting bone may be avoided from aggressively application on cashmere articles, or from use on cashmere articles at all.

Once the cashmere articles have been dried (e.g., with the air gun), the cashmere articles may be laid flat on drying racks to dry for at least about 1, 5, 10, 20, 30, 40, 50, 60 or more minutes. In other embodiments, once the cashmere articles have been dried (e.g., with the air gun), the cashmere articles may be laid flat on drying racks to dry for at most about 60, 50, 40, 30, 20, 10, 1 or fewer minutes. The cashmere articles may then proceed to other treatment processes (e.g., additional dry cleaning processes). Any step during the treatment of cashmere articles may be performed by a user (e.g., a human) or a machine (e.g., a robot).

In some embodiments, caramelized sugar stains or tannin stains may be identified so they may be treated with different or additional steps. Spillage of fruit juices, soft drinks, and alcoholic beverages may form stains that are subject to caramelization. Tannin stains, including tea, coffee, or tomatoes, may not be caramelized but may be removed with the same spotting agents. The caramelized sugar stain and tannin stain may be usually invisible before they are subjected to heat. After being exposed to the heat of drying and/or finishing, the sugar in the juice or beverage may be caramelized and turn yellow, tan, or brown. The appearance of this caramelized sugar stain may be similar to tannin stains. The degree of darkness of the brownish color may be related to the degree of caramelization. For instance, a darker brownish color may indicate a higher degree of caramelization. The size of the stain may be a small dot or a large irregular area caused by a spilled drink. Caramelized sugar stains may be absorbed (not built up) in the fabric of an article, and may be visible and brown on the reverse side of the fabric. For wool or silk articles, caramelized sugar stains may not be removed via normal spot treatment procedures. In this situation, such wool or silk articles may be soaked overnight in a 3% hydrogen peroxide solution before normal spot treatment procedures.

In some embodiments, alkalies (e.g., alkaline spotting agents) may be used on brownish stains (e.g., caramelized sugar stains). In some other embodiments, alkalies may not be used on the brownish stains. Alkaline spotting agents may not be used on the brownish stains because 1) some fruit juices may include tannin material; 2) ammonia or protein formulas may set any tannin material in a brownish stain; and 3) an alkali (ammonia or protein formula) plus heat may cause caramelization of sugar or sugar-like material on cotton, rayon, or acetate.

Figure 5:
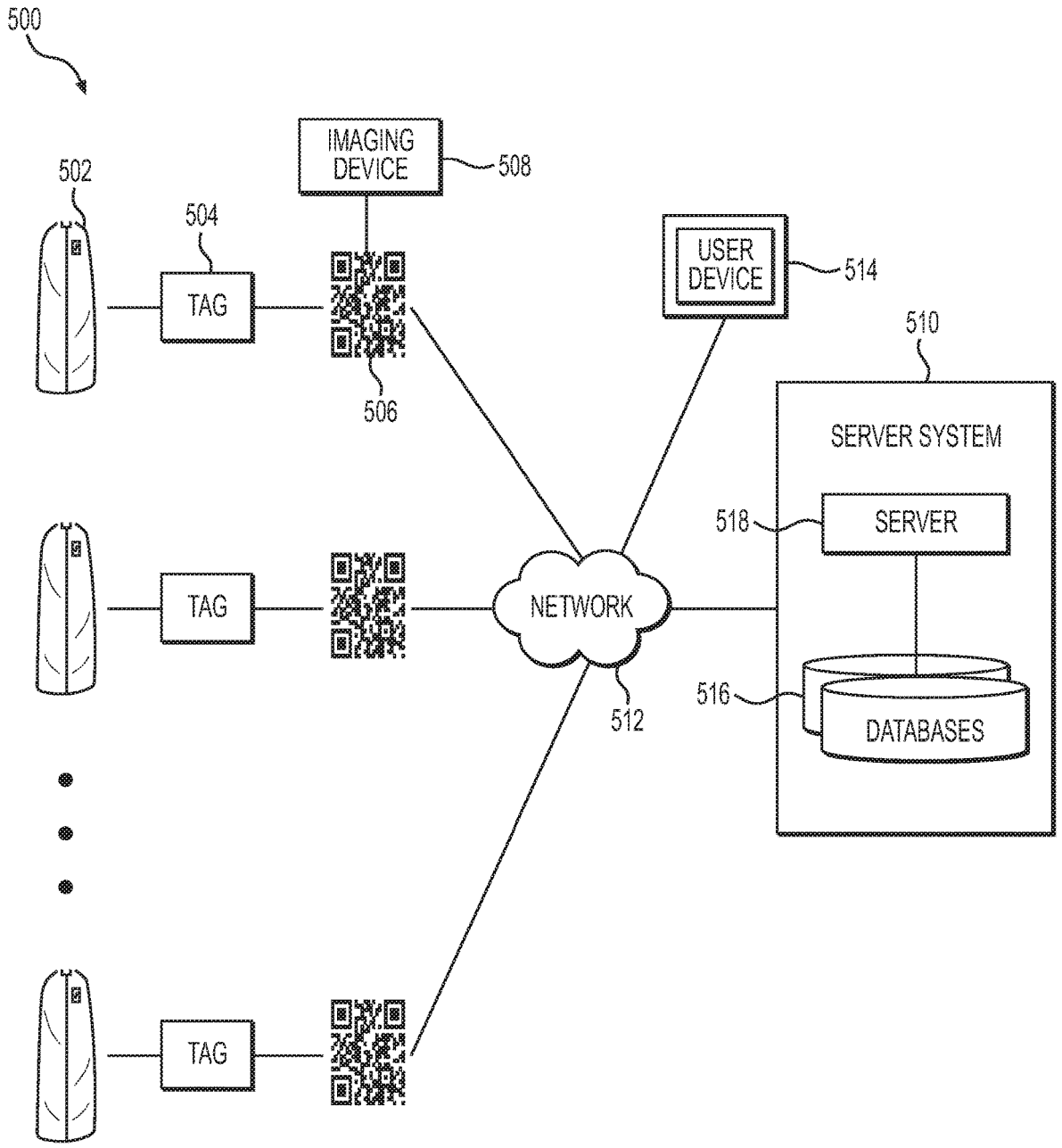
FIG. 5 is a schematic diagram of an exemplary system facilitating the spotting treatment, inspection, and tracking of articles in a networked environment.

FIG. 5 shows a schematic diagram of an exemplary system facilitating a spotting treatment process for an article 502. As shown in FIG. 5, the tag 504 attached to the article 502 may comprise a barcode 506 comprising information regarding spotting treatment of the article 502. When the barcode 506 is scanned by an imaging device 508, the imaging device 508 may transmit the graphical element of the barcode 506 to a server system 510 through a network 512. After analysis process performed by the server system 510, information and/or results may be presented on a user device 514 to display to a user or a machine.

The barcode 506 may be a visual graphical barcode. The barcode 506 can be any format, such as a text, a picture, a sequence thereof, or the like that can be captured and/or displayed on an imaging device 508. In some embodiments, the imaging device 508 may be a camera operably coupled to a user device 514. In this situation, the imaging device 508 may be located on the user device 514 and configured to capture an image of the barcode. In some alternative embodiments, the imaging device 508 may be located external to the user device 514, as shown in FIG. 5, and image data of the graphical element may be transmitted to the user device via different communication means (e.g., a network). The imaging device 508 can be controlled by an application/software configured to scan a barcode. The user device 514 may be an electronic device. The electronic device may comprise a mobile device (e.g., smartphone, tablet, pager, personal digital assistant (PDA)), a computer (e.g., laptop computer, desktop computer, server), or a wearable device (e.g., smartwatches). The user device 514 may be a network device capable of connecting a network, such as a local area network (LAN), wide area network (WAN) such as the Internet, a telecommunications network, a data network, or any other type of network.

The barcode 506 can be one-dimensional barcode, two-dimensional barcode or three-dimensional barcode. The barcode 506 can be, for example, one-dimensional barcode that includes linear patterns such as lines and spaces. The lines and spaces may be black-and-white. The lines and spaces can be color. The color may be visible to human eyes. The color of the barcode may be distinguishable by special tools. For instance, the barcode may include print carbon lines detectable using infrared scanner. The barcode 506 can be two-dimensional barcode including various shapes. The two-dimensional barcode may comprise PDF417, Aztec, MaxiCode, and QR code, etc. The barcode may be static or dynamic. The barcode may be changed or updated at certain frequency. The frequency may be in a wide range such as from 100 HZ to 0.001 HZ. The barcode can encode various types of information in any type of suitable format, such as binary, alphanumeric, ASCII, etc., and the code can be based on any standards. The barcode may have various storage capacities that can encode certain amount of data, and variable physical size.

The server system may comprise one or more databases 516 and one or more servers 518. Each of the one or more of databases 516 can be the same as or different from other databases. Each of the one or more of databases 516 can be located in the same location as or be remote from other databases. The one or more databases 516 may be one or more memory devices configured to store data (e.g., the graphical element of the barcode, the spotting treatment of an article, whether a stain on an article is removed or not, spotting agents used to treat an article, etc.). Additionally, the one or more databases 516 may also, in some embodiments, be implemented as a computer system with a storage device. The one or more databases 516 may be used by components of the network layout to perform one or more operations. The one or more the databases 516 may be co-located with the server, and/or co-located with one another on the network.

The one or more servers 518 may be configured to perform one or more operations or analysis consistent with disclosed embodiments. A server may be implemented as a single computer, through which a user device 514 is able to communicate with other components of the network layout. In some embodiments, a user device 514 may communicate with the server 518 through the network 512. In other embodiments, the server 518 may communicate on behalf of a user device 514 with the one or more databases 516 through the network 512. A server 518 may include known computing components, such as one or more processors, one or more memory devices storing software instructions executed by the processor(s), and data. A server can have one or more processors and at least one memory for storing program instructions. The processor(s) can be a single or multiple microprocessors, field programmable gate arrays (FPGAs), or digital signal processors (DSPs) capable of executing particular sets of instructions. Computer-readable instructions can be stored on a tangible non-transitory computer-readable medium, such as a flexible disk, a hard disk, a CD-ROM (compact disk-read only memory), and MO (magneto-optical), a DVD-ROM (digital versatile disk-read only memory), a DVD RAM (digital versatile disk-random access memory), or a semiconductor memory.

The server 518 may perform analysis of the data store in either the databases 516 or memory devices of the server and generate results. The analysis may comprise utilizing one or more algorithms. The one or more algorithms may comprise a machine learning algorithm. The machine learning algorithm may utilize one or more neural networks. A neural network can learn the relationships between an input data set (e.g., spotting treatment history of a given article) and a target data set (e.g., proposed treatment of the given article). The generated results may comprise any information regarding spotting treatment of one or more articles, including, but not limited to, what type of stain is on a given article, who the supervisor is for the given article during the last spotting treatment, what the last spotting treatment of the given article is, the current price or depreciation rate of the given article, and how to treat the stain on the given article based on the given article's spotting treatment history.

The network 512 may be configured to provide communication between various components or devices shown in FIG. 5. The network 512 may be implemented as the Internet, a wireless network, a wired network, a local area network (LAN), a Wide Area Network (WANs), Bluetooth, Near Field Communication (NFC), or any other type of network that provides communications between one or more components. In some embodiments, the network 512 may be implemented using cell and/or pager networks, satellite, licensed radio, or a combination of licensed and unlicensed radio. The network 512 may be wireless, wired, or a combination thereof.

What is claimed is:

1. A method of treatment of one or more articles, comprising:

locating a stain on an article based on a tag comprising a spotting treatment tracker for the article and a treatment name or identifier associated with treatment of the article;

placing a portion of the article comprising the stain on a spotting board having a corrosion-resistant layer;

treating the article with one or both of a wet-side pre-spotting agent and a dry-side pre-spotting agent;

treating the portion of the article comprising the stain with one or both of a steam supply and a vacuum supply of the spotting board;

treating the portion of the article comprising the stain with one or both of the vacuum supply and an air supply of the spotting board until the article is at least partially dry;

inspecting the stain on an inspection surface to determine a status of the stain;

treating the article with a spotting agent treatment based on the determined status of the stain;

re-inspecting the stain on the inspection surface with one or more of a light sensor, a chemical sensor, a humidity sensor, a camera, or an odor sensor;

updating the tag of the article and/or a data record of the article in one or more servers based on one or more results of the re-inspection;

analyzing the updated tag and/or the data record of the article with a machine learning algorithm in accordance with the one or more results of the re-inspection or an additional review; and displaying treatment information associated with the updated tag and/or data record, according to the results of the re-inspection.

2. The method of claim 1, comprising treating the portion of the article comprising the stain with a steam supply and a vacuum supply of the spotting board by:

positioning a steam gun at least two or more inches away from the portion of the article comprising the stain; and moving the steam gun in a defined motion relative to the portion of the article comprising the stain.

3. The method of claim 1, comprising treating the portion of the article comprising the stain with one or both of the vacuum supply and the air supply of the spotting board by moving one or more of a steam gun, the vacuum supply, and the air supply in a defined motion relative to the stain until the article is at least partially dry.

4. The method of claim 1, further including laying the article flat on drying racks to dry for at least 30 minutes.

5. The method of claim 1, wherein the treatment name or identifier is a name or identifier of a technician or supervisor associated with treatment of the article.

6. The method of claim 3, wherein the moving the one or more of the steam gun, the vacuum supply, and the air supply comprises moving the one or more of the steam gun, the vacuum supply, and the air supply in the defined motion relative to the stain until the article is fully dry.

7. The method of claim 1, further including categorizing the stain into one of one or more categories.

8. The method of claim 7, wherein the one or more categories include oil stain, dye stain, or tannin stain.

9. The method of claim 8, where the tannin stain is invisible before being subjected to heat.

10. The method of claim 1, wherein the method is performed by a robot.

11. The method of claim 1, wherein the tag comprises a barcode.

12. The method of claim 3, wherein the defined motion is a circular, a rectangular, a triangular, or a linear motion.

13. The method of claim 1, wherein the additional review is performed after placing the article in a designated area associated with the additional review.

14. The method of claim 1, wherein the displayed treatment information includes a prior treatment of the article associated with a spotting treatment history of the article.

* * * * *